US006945532B2

(12) United States Patent
Orner et al.

(10) Patent No.: US 6,945,532 B2
(45) Date of Patent: Sep. 20, 2005

(54) WORD GAME

(76) Inventors: Jonathan Isaac Orner, 3666 Keystone Ave., #7, Los Angeles, CA (US) 90034; Alexander Chen, 2516 Montana St., Los Angeles, CA (US) 90026-2330

( * ) Notice: Subject to any disclaimer, the term of this patent is extended or adjusted under 35 U.S.C. 154(b) by 184 days.

(21) Appl. No.: 10/647,151

(22) Filed: Aug. 25, 2003

(65) Prior Publication Data

US 2005/0046111 A1 Mar. 3, 2005

(51) Int. Cl.[7] ..... A63F 9/04
(52) U.S. Cl. ..... 273/272; 273/429; 273/146; 273/243
(58) Field of Search ..... 273/146, 272, 273/429, 430, 431, 432, 242, 243

(56) References Cited

U.S. PATENT DOCUMENTS

| | | | | | |
|---|---|---|---|---|---|
| 1,034,633 | A | * | 8/1912 | Mansfield | 273/243 |
| 2,491,883 | A | * | 12/1949 | Welch | 434/167 |
| 3,984,106 | A | * | 10/1976 | White | 273/243 |
| 4,449,710 | A | * | 5/1984 | Davis | 273/249 |
| 4,877,254 | A | * | 10/1989 | Yuscavage | 273/249 |
| 5,660,389 | A | * | 8/1997 | Freda, III | 273/249 |
| 6,019,372 | A | * | 2/2000 | Polaski et al. | 273/272 |
| 6,367,798 | B1 | * | 4/2002 | Lawal | 273/272 |
| 6,692,002 | B2 | * | 2/2004 | Kummer | 273/272 |

FOREIGN PATENT DOCUMENTS

| | | | |
|---|---|---|---|
| GB | 2161083 | * | 1/1986 |

* cited by examiner

*Primary Examiner*—William M. Pierce

(57) ABSTRACT

A word game relating to verbal communication and word association. The present invention comprises several six sided dice with letters, a six sided die with numbers, a game board, 4 pawns, one or more timers, and a deck of cards. Each set of lettered dice comprise 4 dice, each with six faces, each face thereof containing one letter of the alphabet, covering the full 26 letter alphabet, excluding X and Z. 100 or more cards are in the deck each card containing a title and sequentially numbered answers. Each team is assigned a pawn to move about the board. The numbered die is used to determine the number of spaces to move a pawn forward. A timer is used to limit time during various turns. The board comprises spaces with colors, numbers and indicia. The colors determine which teams are allowed to participate in a turn. Each pawn color is represented on the board. As an example, the colors of the 4 pawns may be red, blue, green and yellow respectively. So, if a team lands on a space with red and blue on it, they compete with teams having red and blue pawns. The numbers on the board indicate which numbered answers are to be used. For example if a team lands on a space with the number 3, then the 3$^{rd}$ answer on a selected card is used. The object of the game is for a translator on each participating team to describe answers to his teammates using only words that begin with letters showing on the dice. As an example, the lettered dice are rolled and show C, L, O, and P and the answer on a selected card is "Boston". The translators must think of hints beginning with C, L, O, or P and convey the answer "Boston" to their respective teammates; for example, the translators can say "city", "original colony", "Celtics play" and so on, as long as each word starts with C, L, O, or P. Whichever team's guessers say "Boston" first within the time limit win the turn. The goal is to be the first team to reach the finish and successfully guess the final answer. To add another level of challenge to the game, various spaces contain the phrase "Challenge!" indicating that 2 correct answers must be guessed by a single team within the standard time limit.

16 Claims, 4 Drawing Sheets

WORD GAME

BACKGROUND OF INVENTION

Various word games and puzzles are known. Some games employ dice with letters which are used to form words. Many word games utilize some type of selection object such as dice or a spinning wheel. Many of the games are based upon vocabulary and word recognition. Some of these games are focused on younger individuals with a basic skill level, while other games focus on adults with more advanced skills. Several of these games also require writing answers on paper and keeping score. It would be useful to provide a word game which combines competitive verbal interaction and creative thinking in a board game format that is challenging to individuals of varying skill levels.

BRIEF SUMMARY OF INVENTION

The invention relates to a word game which is played using one or more sets of colored dice with letters. Pawns, a game board, a deck of cards, one or more timers, and a numbered die are also employed. Each set of colored lettered dice comprise 4 dice, each with six faces, each face thereof containing one letter of the alphabet, covering the full 26 letter alphabet, excluding X and Z. No letter is repeated within a set, though within a game there may be several sets of dice having various combinations of letters. Each set of lettered dice is colored so as to make it distinguishable from each other set.

The pawns comprise 4 colored pawns, each colored distinctively from the other 3 pawns. The pawns are used to distinguish one team from another and track the forward progress of each team on the game board. For example, if the 4 pawns are distinctly colored red, blue, green, and yellow respectively, then there can exist only one red team, one blue team, one green team, and one yellow team, respectively.

A team comprises 2 or more players, consisting of a translator and guessers.

The game board comprises a flat cross-shaped board with 4 equally shaped arms. Printed or drawn on the board are linked spaces along a linear path. The spaces contain start and finish indicia, numbers, and colors. Each arm of the board contains a pair of start and finish indicia corresponding to each respective team color.

The cards each contain a category title and four or more answers numbered sequentially. The numbered answers on the cards correspond to numbers on the game board. A timer is used to limit time during various turns. A numbered die contains numbers on respective faces and is used to indicate the number of spaces to advance a pawn.

The object of the word game is for a translator to verbally convey answers to his teammates, using hints beginning only with letters specified on the lettered dice. As an example, a team lands on a space with the number 7; the corresponding 7th answer on a card is "Boston". For this example, the lettered dice are showing C, L, O, and P. The translator must think of words beginning with C, L, O, or P and convey the answer "Boston" to his teammates; for example, the translator can say "city", "original colony", "Celtics play" and so on, as long as each word starts with a valid letter. If the guessers say "Boston" within the time limit, they win the turn and roll the numbered die to advance.

Colors within spaces on the board indicate which teams may compete during a turn. As an example, the four colors on the board may be red, blue, green and yellow, each corresponding to a respective pawn color. If the team with a green pawn, which we will call the green team, lands on a space with the colors blue and red on it, the green team competes with the blue team and the red team. In another example, if the green team lands on a space with yellow on it, the green team competes with the yellow team.

When multiple teams compete during a turn, each team designates its own translator and guessers. As an example, the green team lands on a space with yellow, blue and the number 3 on it. The $3^{rd}$ answer on a selected card is "zero," and the letters showing on the dice are S, W, E, and I. The green team designates its translator, the yellow team designates its translator, and the blue team designates its translator. The non-translators on each team are guessers. Once the translating begins, valid words spoken by any translator could include, "seven without seven", "I subtract everything" and so on, as long as each word starts with a letter showing on the dice. The guessers may say anything they wish. The team with the first guesser to say, "zero" wins the turn and rolls the numbered die to advance.

The game board also contains "Challenge!" spaces. When landing on a "Challenge!" space, a translator chooses two answers on a card to translate. Upon guessing both answers within the time limit, the translator's team rolls the numbered die twice to advance. As an example, the green team lands on a "Challenge!" space and their translator chooses "fox" and "fir tree" as two answers to translate from a selected card. If the translator gives good hints and his teammates guess the answers "fox" and "fir tree" within the time limit, their team rolls the numbered die to advance; for example, if they roll a 3, they move forward 3 spaces.

BRIEF DESCRIPTION OF DRAWINGS

The invention will be more fully described in the following detailed description in conjunction with the drawings in which.

DETAILED DESCRIPTION

Figure 1:
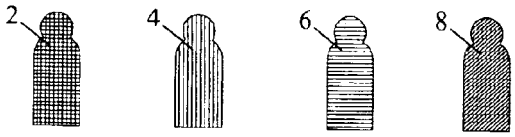
FIG. 1 is a pictorial view of four colored pawns.

The word game is played using 2 to 4 pawns. FIG. 1 shows 4 pawns, each pawn having a pattern representing distinct coloring compared to the other 3 pawn colorings. In the preferred embodiment, there would exist one yellow pawn 2, one red pawn 4, one blue pawn 6, and one green pawn 8. Each team is assigned to a pawn. A team consists of 2 or more people. For example, if the 4 pawns are colored yellow, red, blue and green, respectively, then there may exist one yellow team, one red team, one blue team and one green team, each comprising 2 or more people.

Figure 2:
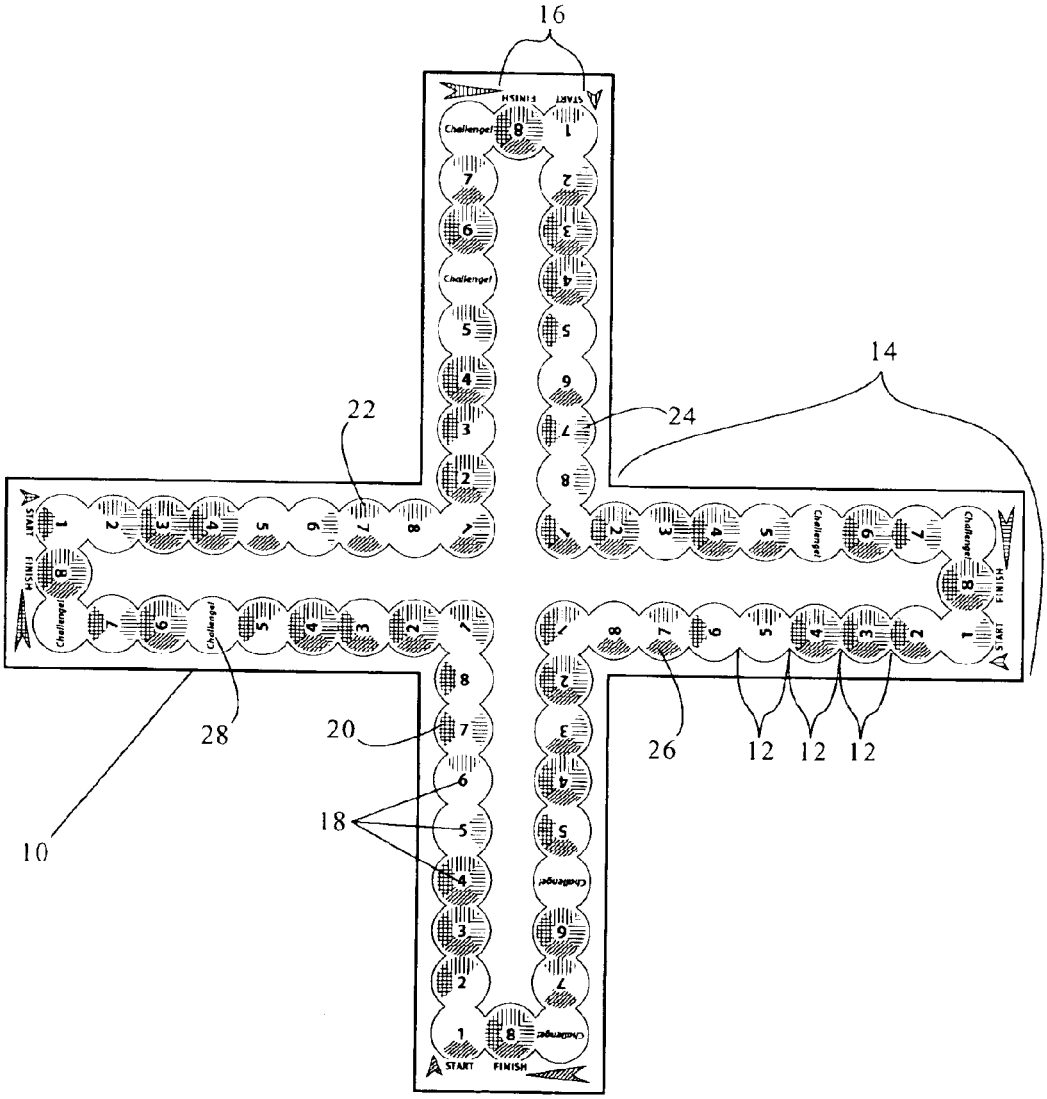
FIG. 2 is a plan view of the game board.

In FIG. 2 the game board 10 is flat and in the form of a cross with equally shaped arms 14. The board 10 can be made using standard methods and materials, including cardboard, paper, printing, cutting, wrapping and gluing. All artwork should be on one side, and the back of the board 10 may be left blank as it forms no part of the game. Linked circular spaces 12 are printed on the board 10 along a continuous linear path. Each arm 14 of the board 10 contains a pair of start and finish spaces 16, which mark the start and finish point for each team's respective pawn. One pair of start and finish spaces 16 exists per pawn, and thus one pair of start and finish spaces 16 exists per team. Each team uses a different pair of start and finish spaces 16, and the distance between each team's pair of start and finish spaces 16 is the same as the distance between each other team's pair of start and finish spaces 16. For example, if the yellow team has its finish space 55 spaces away from its start space, then the red team, blue team, and green team each respectively have their own finish spaces which are 55 spaces away from their own start spaces.

Numbers 18 are printed within various spaces 12. Depending on the total spaces 12 existing on the board 10, the numbers 18 within the spaces 12 may range from 1 through 4 or greater and may appear on more than one space 12.

Spaces 12 with the word "Challenge!" 28 exist throughout the board.

Each space 12 on the board 10, other than a "Challenge!" space 28, contains one or more colors on it corresponding with pawn colors 2, 4, 6, 8. For example, there are spaces on the board 10 which contain yellow 20, the same color as the yellow pawn 2. There are spaces on the board 10 which contain red 22, the same color as the red pawn 4. There are spaces on the board 10 which contain blue 24, the same color as the blue pawn 6. There are spaces on the board 10 which contain green 26, the same color as the green pawn 8. Each space 12 can have one more of these colors in it. For example, one space may have yellow and blue, a second space may have green and blue, a third space may have red, yellow and green, a fourth space may have green, a fifth space may have red and blue, and so on. Any combination of the pawn colors may be represented in a space 12, so long as each color is clearly defined.

Figure 3:
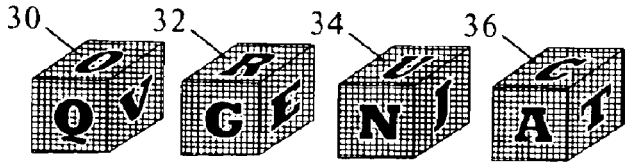
FIG. 3 is a pictorial view of a first set of colored lettered dice.
Figure 4:
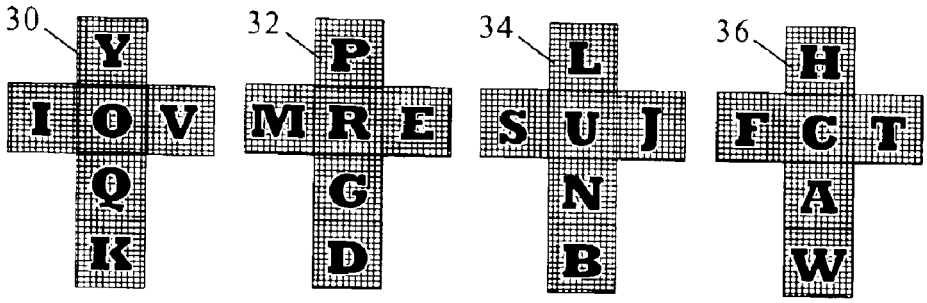
FIG. 4 is a diagrammatic view of the four dice in FIG. 3.
Figure 5:
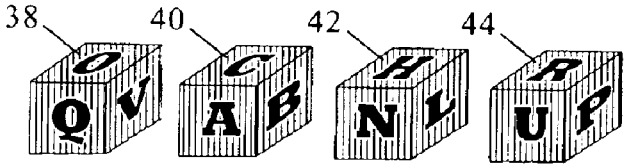
FIG. 5 is a pictorial view of a second set of colored lettered dice.
Figure 6:
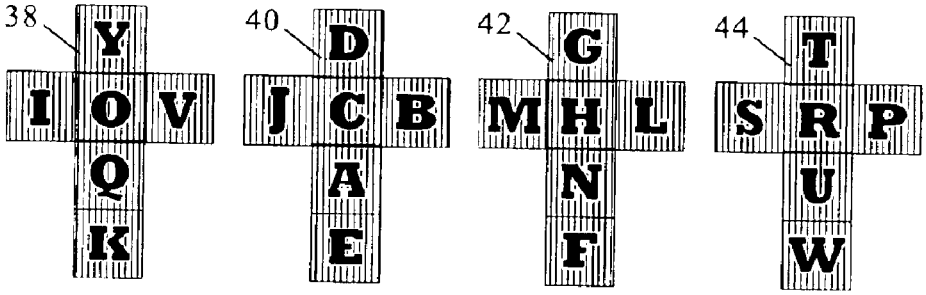
FIG. 6 is a diagrammatic view of the four dice in FIG. 5.
Figure 7:
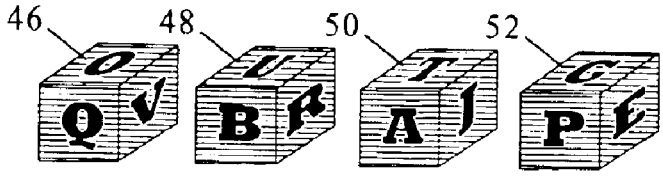
FIG. 7 is a pictorial view of a third set of colored lettered dice.
Figure 8:
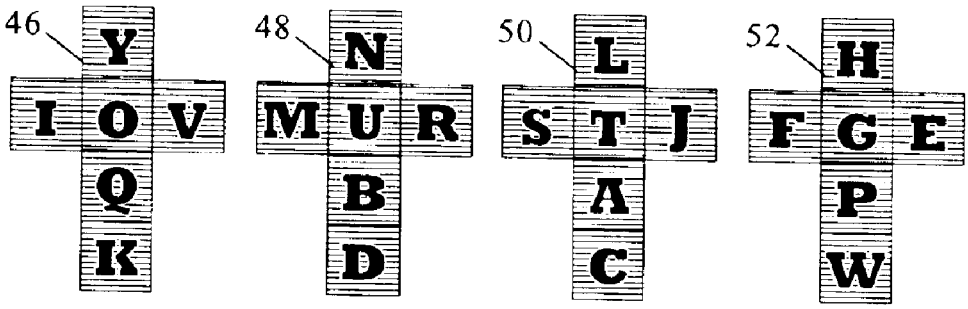
FIG. 8 is a diagrammatic view of the four dice in FIG. 7.
Figure 9:
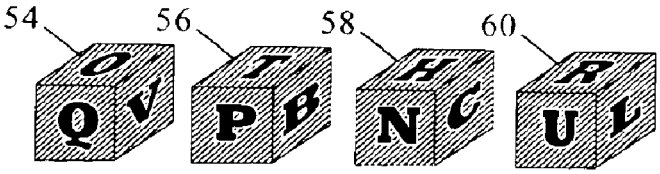
FIG. 9 is a pictorial view of a fourth set of colored lettered dice.
Figure 10:
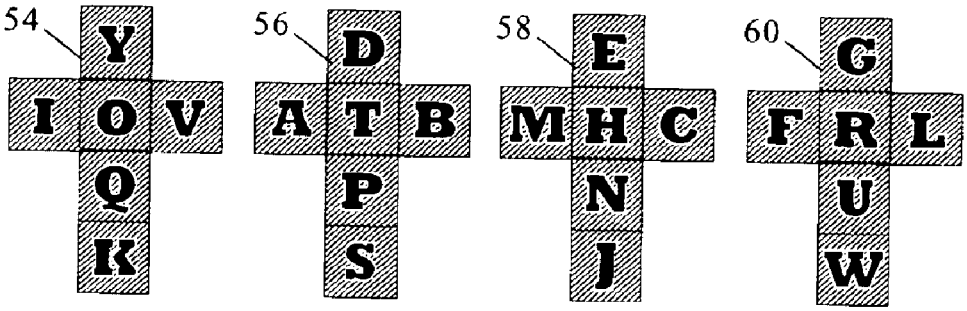
FIG. 10 is a diagrammatic view of the four dice in FIG. 9.

In the illustrated embodiment, sets of 4 lettered dice are employed. A first possible set of 4 lettered dice is shown in FIG. 3, a second possible set of 4 lettered dice is shown in FIG. 5, a third possible set of 4 lettered dice is shown in FIG. 7, and a fourth possible set of 4 lettered dice is shown in FIG. 9. Each die within each set has six sides, and each face has a letter of the alphabet as shown in FIG. 4, FIG. 6, FIG. 8, and FIG. 10. In the illustrated embodiment each die 30, 32, 34, 36, 38, 40, 42, 44, 46, 48, 50, 52, 54, 56, 58, 60 within a set has six faces, each face thereof contains one letter of the alphabet, covering the full 26 letter alphabet, excluding X and Z. Each set of dice is colored so as to distinguish it from each other set.

Figure 11:
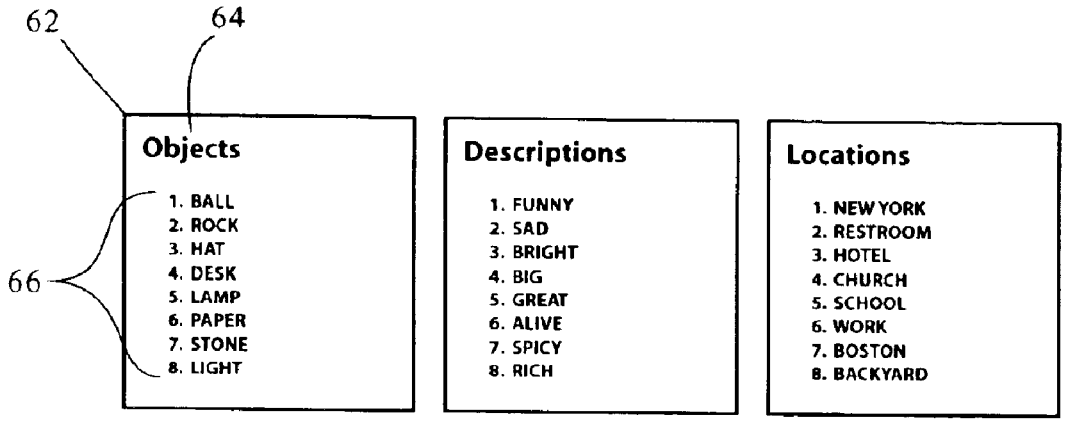
FIG. 11 is a plan view of cards containing category titles and numbered answers.

FIG. 11 shows 3 cards 62 containing respectively the titles 64 "Objects", "Descriptions", "Locations" and containing numbered answers 66 corresponding to each title 64. Various titles 64 and answers 66 may be used to appeal to different interests and cultures. There are 100 cards or more in the preferred embodiment of the game and the cards typically have the title 64 and answers 66 printed on one face thereof. The back faces of the cards can contain any intended design or logo or may be left blank as they form no part of the game. The titles 64 and answers 66 may be printed in upper or lower case or in any size or style to suit the visual and esthetic appeal of the game. The numbered answers 66 on the cards correspond to numbers 18 within spaces 12 on the board 10. Each card contains one title 96 and a number of answers 98 equal to the greatest number on the board. Each numbered 18 space 12 designates which answer 66 on a card is to be used during a turn. For example if a team lands on a space 12 with the number 7 on it, then the corresponding $7^{th}$ answer 66 on a selected card is used.

The lettered dice designate valid letters to begin words with. These letters apply to words spoken by the translator on each team. For example, as illustrated in FIG. 3 the letters O, R, U, and C are facing up on the 4 dice 30, 32, 34, 36 respectively, so the translator may only say words beginning with O, R, U, or C to describe an answer 66 on a card 62 to his teammates.

Figure 13:
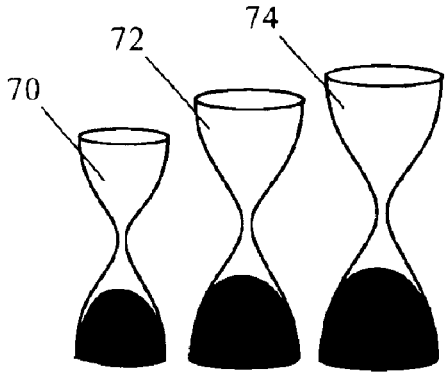
FIG. 13 is a pictorial view of 3 timers.

A timer, such as one of the three sand timers depicted in FIG. 13 is used to limit time during various turns. A preferred timer would count down one minute 70, 90 seconds 72 or two minutes 74, depending on the skill level of the players.

The game challenges players to exercise their vocabularies and problem solving skills and can provide both entertainment and educational benefit.

Figure 12:
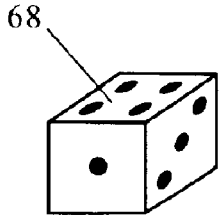
FIG. 12 is a pictorial view of a numbered die.

The game is played in the following manner. An appropriate timer is selected based on the skill level of the players. The game board is placed face-up on a playing table. The answer cards may either be placed faced-down on the table or put vertically in a box capable of hiding the answers. Two to four teams are formed. Each team consists of two or more players. Within each team there is a translator; the remaining teammates are guessers. Each team chooses a pawn and a set of similarly colored letter dice. Each team is defined by their pawn color. For example, if two teams are playing and they choose a red pawn and a green pawn respectively, they become the red team and the green team respectively. Each pawn is placed on a corresponding colored start space on the board. The numbered die as shown in FIG. 12 is rolled by each team. The team rolling the highest number on the die 68 advances their pawn first.

For example, the green team rolls the highest number, then rolls a 5 to advance. They move their green pawn forward 5 spaces. In this example the green team lands on a space with a number and colors. The colors on the space represent each team allowed to compete with the green team on this turn. Since it's their turn, the green team participates in the turn whether or not their color is on the space. The green team designates a translator who selects a card. The translator looks at the title and the numbered answer on the card that matches the number on the space. This is the answer for the turn. The translator tells everyone the title of the card. Each team with a color represented on the space participates by designating its own respective translator. The green team's translator shows the card to the other teams' translators. The green team's translator rolls his lettered dice. All translators then begin describing the answer, using only words beginning with letters facing up on the rolled dice. The guessers on each team can say anything they want. If all teams are participating, no timer is used. If one or more teams are not participating because their color isn't on the space, a timer is used. The team with guessers who say the answer first win the turn and roll the numbered die to advance. If a team's translator says the answer on the card their team is dismissed from the turn. If a team's translator says any word not beginning with letters facing up on the dice, their team is dismissed from the turn. If the turn is being timed, and time runs out, play passes to the team to the left The translator role may shift to a new member within a team for each new turn. Each team may decide when and if a translator role shifts within their team.

Another type of space on the board is a "Challenge!" space. A team landing on this space plays the turn by themselves. For a "Challenge!" space the team's translator selects two answers on a card and attempts to translate them to the rest of the team within the regular time limit. If both answers are guessed within the time limit, the team rolls the numbered die to advance their pawn the indicated number of spaces.

Various rules are employed, including the following. In order to win the game, a team must guess the correct answer on their turn, on their finish space. To reach the finish, an exact roll isn't required; just a number greater than or equal to the distance to the finish. A translator can never say the answer on a card, even if it begins with a letter facing up on the dice. When a team plays a turn by themselves and their translator uses any invalid word, their turn ends and play passes to the left. When a team's translator uses any invalid word during a turn where two teams are competing, the other team wins the turn. When a team's translator uses any invalid word during a turn where three or four teams are competing, the violating team is dismissed from the turn and the remaining teams replay the space using a new card.

To further increase competition, more limiting rules can be employed. Translators can never say the answer on the card or words that begin with letters NOT facing up on the 4 alpha dice. Acronyms can be used if they consist only of letters showing on the 4 alpha dice. Proper names are permitted. Fake words can never be used. Non-English words cannot be used unless agreed upon prior to the game starting. Translators can NOT say words with a similar spelling and similar meaning as the answer—for example if the answer is "THROW" translators can't say THREW or THROWING. If the answer is a compound word such as "DOGHOUSE" translators can't say DOG or HOUSE since both words are part of the meaning of "DOGHOUSE." Likewise, if the answer is a multiple word answer such as "GEORGE WASHINGTON" translators can't say GEORGE or WASHINGTON, but could say WASH and WASHING because neither one directly gives away the meaning. If the answer is "CATERPILLAR" it is permissible to say CATER, PILLAR, and PILL, since although these words sound like part of the answer, none of them give away the meaning of "CATERPILLAR." It is assumed that the appropriate letters are facing up on the dice in order for any of the above answers to be spoken by the translator.

We claim:

1. A word game comprising a plurality of different colored pawns, each different colored pawn representing a different team of a translator and at least one player;

a flat board containing spaces in a continuous linear path along a plurality of equal arms, each space containing different numbers and different colored areas;

a numbered die for each team to roll in turn to progress their different colored pawn along the spaces from start to finish;

at least one set of six sided lettered dice, each face thereof having a letter, each letter representing the beginning letter of valid words which can be spoken by translators;

a deck of cards, each card containing a title and answers; and wherein upon the pawn landing on a space, the colors of the space representing which teams are allowed to participate in a turn, the number of the space representing the answer to be used on a selected card, rolling a plurality of the lettered dice, obtaining letters from the dice, giving clues to describe the answer on the card using only words that begin with letters obtained from the lettered dice, guessing the answer on the card, and moving forward on the game board towards a designated finish space.

2. The word game of claim 1 further comprising a timer, wherein guessing the answer on the card must occur within the time limit of the timer.

3. The word game of claim 1 wherein the numbered die is a six sided die with the numbers 1, 2, 3, 4, 5, and 6 represented on its faces, one number represented per face.

4. The word game of claim 1 wherein the deck of cards contains at least 100 cards each card containing a title and 4 or more numbered answers.

5. The word game of claim 1 wherein the sets of six sided letter dice comprise one or more sets.

6. The word game of claim 5 wherein each set contains 4 same-colored letter dice, each set having distinctive coloring so as to visually distinguish each set from every other set.

7. The word game of claim 6 wherein each die within a set contains letters on its faces.

8. The word game of claim 7 wherein no two dice within a set have the same letter.

9. The word game of claim 8 wherein each face thereof contains one letter of the alphabet, covering the full 26 letter alphabet, excluding X and Z.

10. The word game of claim 1 wherein the board has 4 arms each arm being equidistant from the center.

11. The word game of claim 10 wherein each arm is across from one other arm and perpendicular to each adjacent arm.

12. The word game of claim 1 wherein various spaces are marked as start and finish spaces.

13. The word game of claim 12 wherein each pair of start and finish spaces correspond to a different colored pawn.

14. The word game of claim 13 wherein a pair of start and finish spaces are contained within each arm of the board.

15. The word game of claim 14 wherein there are 4 pairs of start and finish spaces.

16. The word game of claim 1 wherein various spaces contain the phrase "Challenge!" indicating that 2 correct answers must be obtained within the time limit.

* * * * *